US005186504A

United States Patent [19]

Takaishi et al.

[11] Patent Number: 5,186,504

[45] Date of Patent: Feb. 16, 1993

[54] DOOR LOCK DEVICE

[75] Inventors: Tatsuyuki Takaishi; Masazumi Miyagawa; Hitoshi Nakamura, Yokohama, Japan

[73] Assignee: Ohi Seisakusho Co., Ltd., Yokohama, Japan

[21] Appl. No.: 854,408

[22] Filed: Mar. 19, 1992

[30] Foreign Application Priority Data

Mar. 29, 1991 [JP] Japan ..... 3-20126[U]

[51] Int. Cl.[5] ..... E05C 3/26

[52] U.S. Cl. ..... 292/216

[58] Field of Search ..... 292/216, 280, 337, DIG. 23, 292/DIG. 26, 201

[56] References Cited

U.S. PATENT DOCUMENTS

| | | | |
|---|---|---|---|
| 4,850,625 | 7/1989 | Hori et al. | 292/336.3 |
| 4,913,477 | 4/1990 | Watanuki et al. | 292/216 |
| 4,948,183 | 8/1990 | Yamada | 292/216 X |
| 5,000,495 | 3/1991 | Wolfgang et al. | 292/216 |
| 5,092,638 | 3/1992 | Miyuki | 292/216 |

*Primary Examiner*—Richard E. Moore

*Attorney, Agent, or Firm*—Foley & Lardner

[57] ABSTRACT

A door lock device which comprises a structural base body by which a latch plate and a control mechanism for the latch plate are operatively carried; and a cover plate attached to the structural base body in a manner to cover the latch plate. The cover plate includes larger and smaller flat portions which are mutually intersected and the cover plate has an enclosed aperture which extends between the larger and smaller flat portions and through which the latch plate is exposed.

17 Claims, 3 Drawing Sheets

DOOR LOCK DEVICE

BACKGROUND OF THE INVENTION

1. Field of the Invention

The present invention relates in general to door lock devices, and more particularly to door lock devices of a type which generally comprises a latch plate operatively held by a structural base body, and an apertured cover plate attached to the body having the latch plate exposed through the aperture thereof, so that when a striker is led into the aperture, the striker is caught or latched by the latch plate.

2. Description of the Prior Art

Hitherto, various door lock devices have been proposed and put into practical use particularly in the field of motor vehicles. Widely used are of a type which comprises a latch plate operatively held by a structural base body secured to a door, and an apertured cover plate attached to the body in a manner to expose the latch plate through the aperture thereof, so that when a striker secured to a vehicle body is led into the aperture, the striker is caught or latched by the latch plate. For reinforcing the structural base body, the cover plate is usually constructed of steel plate.

Some of the cover plates used in such conventional door lock devices are shaped flat and have a generally U-shaped structure (or horse shoe structure) for defining the aperture therein.

However, due to the flat and U-shaped structure of the cover plate, the flexural strength of the same in the direction to cross the aperture is poor. This means that the mechanical strength fo the structural base body to which such cover plate is secured is also poor. Thus, when an abnormally large impact force is applied to the lock device by the striker due to sudden closing of the door or the like, it tends to occur that the structural base body of the lock device is damaged. Although increasing the thickness of the structure base body may solve such drawback, the increase in thickness induces a bulky and heavy construction of the door lock device.

SUMMARY OF THE INVENTION

It is therefore an object of the present invention to provide a door lock device which is free of the above-mentioned drawback.

According to a first aspect of the present invention, there is provided a door lock device which comprises a structural base body by which a latch plate and a control mechanism for the latch plate are operatively carried; and a cover plate attached to the structural base body in a manner to cover the latch plate and including larger and smaller flat portions which are mutually intersected, the cover plate having an enclosed aperture which extends between the larger and smaller flat portions and through which the latch plate is exposed.

According to a second aspect of the present invention, there is provided a door lock device which comprises a steel base plate including first and second flat parts which are mutually intersected; a plastic front member secured to the first flat part, the plastic front member being formed with a laterally extending guide groove; a plastic cover member extending behind the steel base plate to cover a control mechanism installed behind the steel base plate; a latch plate controlled by the control mechanism, the latch plate being pivotally connected to an outer surface of the plastic front member in a manner to extend across the guide groove; and a cover plate attached to an outer surface of the plastic front member in a manner to cover the latch plate and including larger and smaller flat portions which are mutually intersected, the cover plate having an enclosed aperture which extends between the larger and smaller flat portions and through which the latch plate is exposed, the enclosed aperture being mated with the guide groove of the plastic front member.

BRIEF DESCRIPTION OF THE DRAWINGS

Other objects and advantages of the present invention will become apparent from the following description when taken in conjunction with the accompanying drawings, in which.

DETAILED DESCRIPTION OF THE INVENTION

Figure 1:
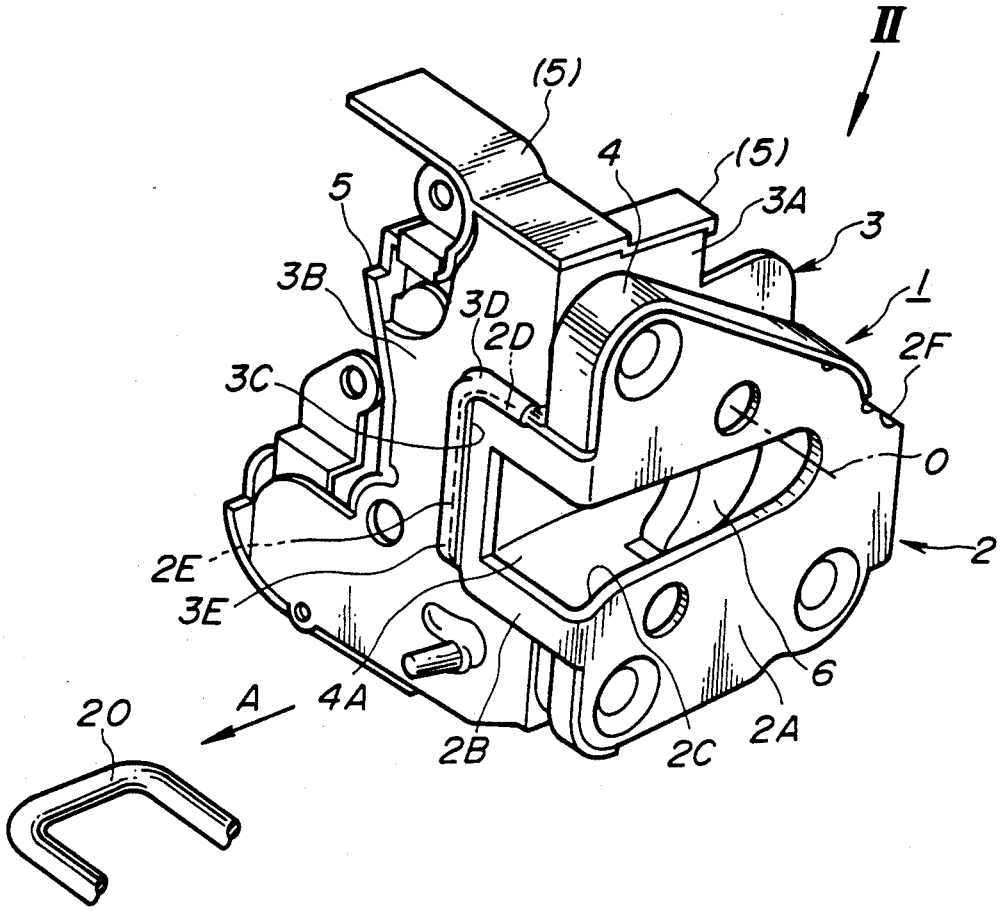
FIG. 1 is a perspective view of a door lock device according to the present invention.
Figure 3:
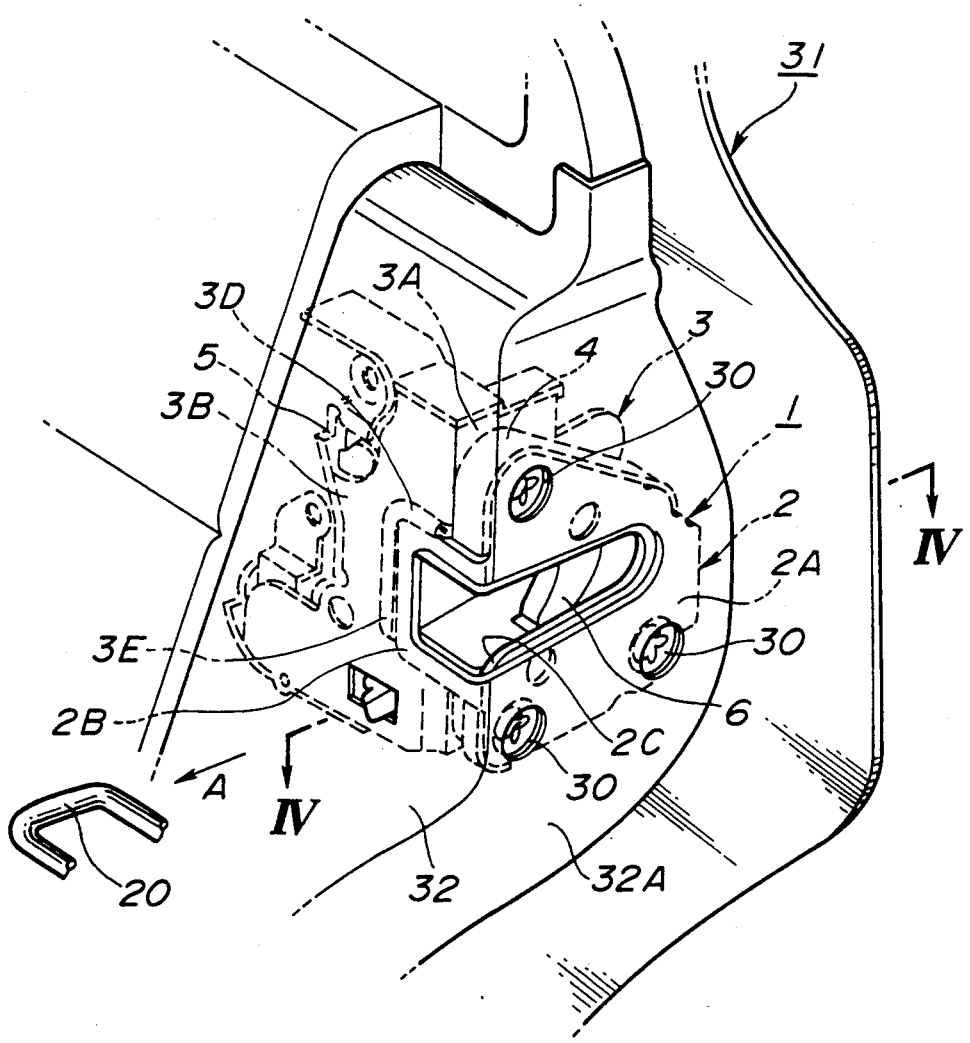
FIG. 3 is a perspective view of an automotive pivot door at the position where the door lock device of the invention is installed.

Referring to the drawings, particularly FIGS. 1 and 3, there is shown a door lock device 1 according to the present invention.

As is shown in FIG. 3, by means of three bolts 30, the door lock device 1 is secured to an inner surface of an inner panel 32 of an automotive pivot door 31.

Denoted by numeral 20 is a striker which is secured to a given portion of a vehicle body. Thus, when the door 31 is pivoted in a door closing direction, that is, in the direction of the arrow "A", the door lock device 1 is brought into engagement with the striker 20 to achieve a latched engagement of the door 31 relative to the vehicle body.

As is seen from FIG. 1, the door lock device 1 comprises generally a steel cover plate 2, a steel base plate 3, a plastic front member 4 and a plastic cover member 5. The steel base plate 3 has a generally L-shaped cross section, including a first flat part 3A to which the plastic front member 4 is secured and a second flat part 3B whose outer surface is exposed.

It is to be noted that the steel base plate 3, the plastic front member 4 and the plastic cover member 5 constitute a structural base body to which the steel cover plate 2 is attached.

The structural base body carries a latch plate 6 which is pivotal about a pivot pin (not shown) extending between the plastic front member 4 and the steel cover plate 2. Denoted by reference "O" is the axis of the pivot pin about which the latch plate 6 pivots. The pivot pin thus can also serve to secure the cover plate 2 to the plastic front member 4.

The plastic front member 4 is formed at its outer side with a laterally extending groove 4A over and across which the latch plate 6 extends. Within a back portion of the groove 4A, there is installed a bumper rubber 7 as is understood from FIG. 4.

A known control mechanism for controlling the latch plate 6 is installed on a back side of the structural base body. This known mechanism is disclosed in, for example, U.S. Pat. No. 4,850,625 granted to Yasuaki HORI et al on Jul. 25, 1989.

Figure 2:
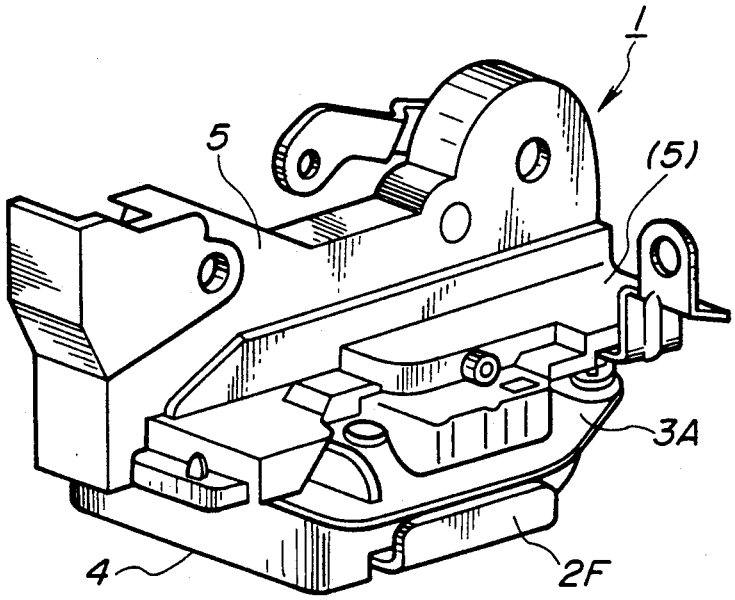
FIG. 2 is a view taken from the direction of the arrow "II" of FIG. 1.
Figure 4:
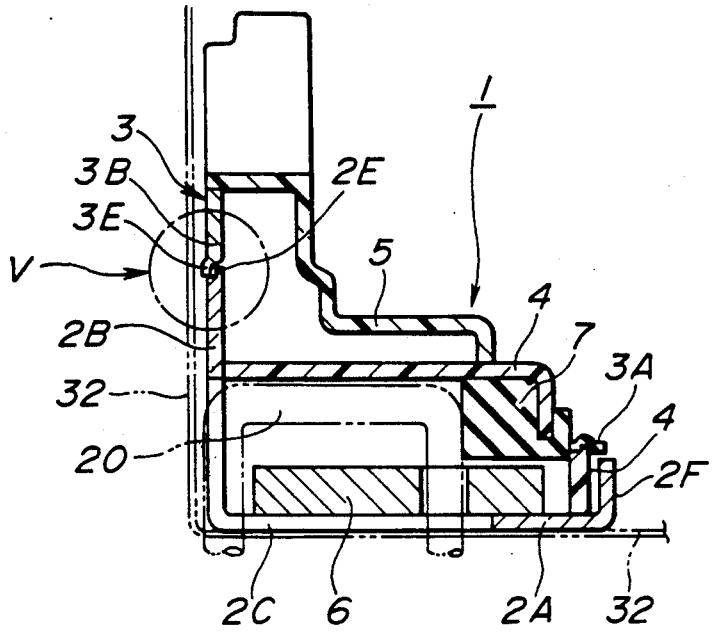
FIG. 4 is a sectional view taken along the line "IV—IV" of FIG. 3.
Figure 5:
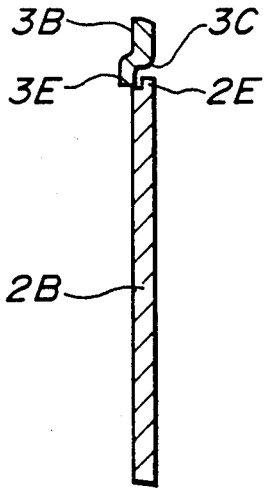
FIG. 5 is an enlarged view of the portion indicated by the arrow "V" of FIG. 4.

As is seen from FIGS. 2 and 4, the plastic cover member 5 extends behind the steel base plate 3 to cover the known control mechanism. With this covering arrangement, the control mechanism is protected from rain water which may enter the door 31.

As is best seen from FIG. 1, the cover plate 2 has a generally L-shaped cross section, including a larger flat portion 2A which is secured to the outer surface of the plastic front member 4, a smaller flat portion 2B which extends perpendicular from one end of the larger flat portion 2A and a very small flange portion 2F (see FIG. 4) which extends perpendicular from the other end of the larger flat portion 2A.

It is to be noted that because of provision of the smaller flat portion 2B and flange portion 2F, the cover plate 2 has a so-called "three dimensional structure" which assures the robustness of the cover plate 2.

The cover plate 2 is formed with an enclosed guide aperture 2C which includes a laterally extending slot (no numeral) formed in the larger flat portion 2A and a rectangular opening (no numeral) formed in the smaller flat portion 2B, the slot and the opening being merged at the mutually joined part between the larger and smaller flat portions 2A and 2B.

When the cover plate 2 is properly arranged on the structural base body, the large flat portion 2A is in parallel with the first flat part 3A of the steel base plate 3 and the smaller flat portion 2B is flush with the second flat part 3B of the base plate 3, as is understood from FIG. 4.

As is seen from FIG. 1, for achieving the flush arrangement of the smaller flat portion 2B with the second flat part 3B, the latter is formed with a rectangular recess 3C into which a leading part of the smaller flat portion 2B is received. The rectangular recess 3C is formed along its upper and side edges with outwardly protruded hedge portions 3D and 3E which cover peripheral edges 2D and 2E of the leading part of the smaller flat portion 2B.

As is understood from FIGS. 1 and 4, the peripheral edges 2D and 2E are pressed to have a reduced thickness.

As is seen from FIG. 3, upon assembly in the door 31, the door lock device 1 is positioned in an angled corner part 32A of the inner panel 32 of the door 31. The corner part 32A includes two intersected flat portions of the inner panel 32, which are a perpendicularly bent flat portion and a flat outer portion of the major part of the inner panel 32. As shown in the drawing, the cover plate 2 is so arranged that the larger flat portion 2A thereof is bolted to the perpendicularly bent flat portion of the inner panel 32 and the smaller flat portion 2B thereof faces the flat outer portion of the inner panel 32. The corner part of the inner panel 32 has an opening which is coincident with the guide aperture 2C of the cover plate 2.

When the door 31 is pivoted in the closing position and almost closed, the guide aperture 2C of the cover plate 2 receives the striker 20 to allow a latched engagement between the striker 20 and the latch plate 6. With this, the door 31 is latched to the vehicle body at its fully closed position.

When the control mechanism is actuated by a remotely positioned control handle, such as outer handle, inner handle or the like, the latched condition of the latch plate 6 is cancelled. Thus, the striker 20 is released from the latch plate 6 permitting opening movement of the door 31. The operation of such control mechanism and the latch plate 6 is described in detail in the aforementioned U.S. Pat. No. 4,850,625.

In the following, advantages of the present invention over the prior art will be described.

First, because of provision of the smaller flat portion 2B, the flexural strength of the cover plate 2 in the direction to cross the aperture 2C is increased as compared with that of the afore-mentioned prior art. In fact, the smaller flat portion 2B can serve as a reinforcing strut for the cover plate 2.

Second, due to provision of the smaller flat portion 2B and small flange portion 2F which extend perpendicular from the larger flat portion 2A, a so-called "three dimensional structuure is possessed by the cover plate 2, which assures not only a stout structure of the cover plate 2 but also a robustness of the door lock device 1.

Third, because the base plate 3 has the hedge portions 3D and 3E mated with the peripheral edges 2D and 2E of the smaller flat portion 2B, a so-called "water sealed engagement" is established therebetween. Thus, the control mechanism installed in the structural base body is protected from rain water of the like.

What is claimed is:

1. A door lock device comprising:

a structural base body by which a latch plate and a control mechanism for said latch plate are operatively carried, said base body being formed with guide groove over and across which said latch plate extends; and a cover plate directly attached to said structural base body in a manner to cover said guide groove and said latch plate, said cover plate including mutually intersected larger and smaller flat portions which are integral with each other and affixed to side and front portions of said structural base body, said cover plate having an enclosed aperture which extends between said larger and smaller flat portions and through which said latch plate is exposed.

2. A door lock device comprising:

a structural base body by which a latch plate and a control mechanism for said latch plate are operatively carried; and a cover plate attached to said structural base body in a manner to cover said latch plate and including larger and smaller flat portions which are mutually intersected, said cover plate having an enclosed aperture which extends between said larger and smaller flat portions and through which said latch plate is exposed, said cover plate further including a flange portion which is raised from said larger flat portion in the same direction as said smaller flat portion from said larger flat portion at a position remote from said small flat portion.

3. A door lock device as claimed in claim 2, in which said enclosed aperture includes an enlongate slot formed in said larger flat portion and a rectangular opening formed in said smaller flat portion.

4. A door lock device as claimed in claim 3, in which said cover plate is constructed of steel.

5. A door lock device as claimed in claim 3, in which said structural base body is formed with a guide groove over and across which said latch plate extends.

6. A door lock device comprising:

a structural base body by which a latch plate and a control mechanism for said latch plate are operatively carried; and a cover plate attached to said structural base body in a manner to cover said latch plate and including larger and smaller flat portions which are mutually intersected, said cover plate having an enclosed aperture which extends between said larger and smaller flat portions and through which said latch plate is exposed;

wherein said structural base body includes a steel base plate including first and second flat parts which are mutually intersected;

a plastic front member secured to said first flat part, said plastic front member being formed with a guide groove over and across which said latch plate extends; and a plastic cover member extending behind said steel base plate to cover said control mechanism.

7. A door lock device as claimed in claim 6, in which said larger flat portion of said cover plate is secured to an outer surface of said plastic front member in such a manner that said smaller flat portion of the same is flush with said second flat part of said steel base plate.

8. A door lock device as claimed in claim 7, in which said second flat part of said steel base plate is formed with a rectangular recess into which a leading part of said smaller flat portion of said cover plate is received.

9. A door lock device as claimed in claim 8, in which said rectangular recess is formed along its upper and side edges with outwardly protruded hedge portions which cover peripheral edges of the leading part of said smaller flat portion.

10. A door lock device as claimed in claim 9, in which said peripheral edges of the leading part of said smaller flat portion are pressed to have a reduced thickness.

11. A door lock device comprising:

a steel base plate including first and second flat parts which are mutually intersected;

a plastic front member secured to said first flat part, said plastic front member being formed with a laterally extending guide groove;

a plastic cover member extending behind said steel base plate to cover a control mechanism installed behind said steel base plate;

a latch plate controlled by said control mechanism, said latch plate being pivotally connected to an outer surface of said plastic front member in a manner to extend across said guide groove; and a cover plate attached to an outer surface of said plastic front member in a manner to cover said latch plate and including larger and smaller flat portions which are mutually intersected, said cover plate having an enclosed aperture which extends between said larger and smaller flat portions and through which said latch plate is exposed, said enclosed aperture being mated with said said guide groove of said plastic front member.

12. A door lock device as claimed in claim 11, in which said larger flat portion of said cover plate is secured to the outer surface of said plastic front member and in which said smaller flat portion of said cover plate is flush with said second flat part of said steel base plate.

13. A door lock device as claimed in claim 12, in which said second flat part of said steel base plate is formed with a rectangular recess into which a leading part of said smaller flat portion of said cover plate is received.

14. A door lock device as claimed in claim 13, in which said rectangular recess is formed along its upper and side edges with outwardly protruded hedge portions which cover peripheral edges of the leading part of said smaller flat portion.

15. A door lock device as claimed in claim 14, in which said peripheral edges of the leading part of said smaller flat portion are pressed to have a reduced thickness.

16. A door lock device comprising:

a structural base body on which a latch plate and a control mechanism for said latch plate are operatively carried, said base body being formed with a guide groove over and across which said latch plate extends; and a cover plate including mutually intersected larger and smaller flat portions, said cover plate being secured to said base body in such a manner that said larger and smaller flat portions cover side and front portions of said guide groove respectively;

wherein said cover plate further includes an enclosed aperture which extends between said larger and smaller flat portions and through which said latch plate is exposed.

17. A door lock device as claimed in claim 16, wherein said enclosed aperture is mated with said guide groove.

* * * * *